United States Patent [19]

Lunt

[11] Patent Number: 4,819,275

[45] Date of Patent: Apr. 11, 1989

[54] DISPOSABLE GOWN FOR MEDICAL PATIENTS

[76] Inventor: Audrey T. Lunt, 6371 Vermont Hill Rd., South Wales, N.Y. 14139

[21] Appl. No.: 122,175

[22] Filed: Nov. 18, 1987

[51] Int. Cl.[4] ..... A41B 9/00

[52] U.S. Cl. ..... 2/114; 2/DIG. 7

[58] Field of Search ..... 2/DIG. 7, 114, 80

[56] References Cited

U.S. PATENT DOCUMENTS

| | | | |
|---|---|---|---|
| 3,570,012 | 3/1971 | Winters | 2/114 |
| 3,803,640 | 4/1974 | Ericson | 2/DIG. 7 |
| 3,824,625 | 7/1974 | Green | 2/114 |
| 4,052,752 | 10/1977 | Green | 2/DIG. 7 |
| 4,524,463 | 6/1985 | Ogden | 2/114 |
| 4,570,268 | 2/1986 | Freeman | 2/DIG. 7 |
| 4,631,756 | 12/1986 | Scrivens | 2/114 X |
| 4,674,132 | 6/1987 | Stein et al. | 2/114 |

*Primary Examiner*—Ronald Feldbaum
*Attorney, Agent, or Firm*—Michael Ebert

[57] ABSTRACT

A disposable, double-breasted gown for medical patients fabricated of non-woven synthetic plastic sheeting. The gown body is formed from a rectangular blank whose straight upper long edge is die cut to provide chamfered corners, an off-center neck indentation and isosceles triangular arm-hole indentations on the left and right sides of the arcuate indentation, the resulting straight edge shoulder segments formed between the corners and the indentations all having the same length. The peaks of the triangular indentations are aligned with parallel left and right transverse fold lines that define a rear gown section on one side of which is a relatively narrow left-front gown section, and on the other side of which is a broad right-front gown section. The left-front section is folded over the rear section and the right-front section is then folded over to overlap the folded left-front section, the straight edge segments of the folded-over left and right front sections being ultrasonically bonded to the corresponding segments of the rear section to define left and right arm openings. Ultrasonically seamed to these arm openings are short sleeves to complete the gown which is then provided with a tie string, one being attached to the rear panel and the other to the right-front section.

6 Claims, 1 Drawing Sheet

DISPOSABLE GOWN FOR MEDICAL PATIENTS

BACKGROUND OF INVENTION

1. Field of Invention

This invention relates generally to protective gowns to be worn by patients in a medical environment such as a hospital, and more particularly to a disposable gown of this type formed of non-woven, synthetic plastic sheeting, the gown being double breasted to accommodate itself to the size of the patient and affording adequate coverage for the patient wearing the gown.

2. Status of Prior Art

In the environment of a hospital or other medical facility, it is common practice to supply a patient with a protective gown which, though providing adequate body coverage and preserving the patient's modesty, can be quickly put on or removed to facilitate medical examinations and other required procedures.

Thus a patient may enter a hospital for the purpose of undergoing minor surgery with a view to being discharged the same day. In the course of this day, the patient may be called upon to walk from one room to another to undergo various examinations or treatments, and at various times may be seated or asked to lie prone on an examination table. A patient gown suitable for these activities must at the very least provide some degree of warmth as well as adequate body coverage to preserve modesty and to act as a barrier against germs. In addition, the nature of this gown must be such that it fits the typical adult patient regardless of the patient's sex and size and can be put on or removed quickly and without difficulty.

In many hospitals, reusable patients' gowns are available which are fabricated of woven natural or synthetic materials such as cotton or polyester. When the gown is formed of woven fabrics, such as cotton, in order to avoid frayed edges and to prevent irritating the skin of the patient, sewn hems and finished borders are required, thereby adding to manufacturing costs. Such gowns are often not only ill fitting, but must be laundered and resterilized after each wearing, a requirement which adds substantially to the operating costs of a hospital.

Moreover, patients today are aware of many serious infectious diseases being treated in hospitals and other medical facilities, and the danger of cross-contamination. Patients, therefore, are understandably reluctant to don a gown that may have been used previously by a patient suffering from a serious disease, even though he may be assured by the hospital that the reusable gown is sterile and safe.

Also now available are disposable medical gowns, such as those disclosed in the Benevento et al. U.S. Pat. No. 3,911,499 and the Lunt U.S. Pat. No. 4,608,719, which are made of non-woven, synthetic plastic fabrics and can be discarded after a single use. But such known gowns do not fully satisfy the requirements for a medical gown which can be easily put on by a patient or removed. Thus the nature of the medical cover gown disclosed in the above-identified Lunt patent is such that it must be slipped over the head of the wearer. It cannot simply be put on in the manner of a conventional gown by insertion of the arms of the wearer into the sleeves of the gown.

SUMMARY OF INVENTION

In view of the foregoing, the main object of this invention is to provide a disposable medical gown which is usable by adult patients and is double-breasted to accommodate itself to the size of the patient and to afford adequate coverage for the patient wearing the gown.

A significant feature of a gown in accordance with the invention is that it is fabricated of non-woven, synthetic plastic fabric sheeting without the need for sewing, all necessary seams being created ultrasonically.

More particularly, an object of this invention is to provide a short-sleeve gown of the above type whose body is formed from a single blank of non-woven sheeting which is die cut, folded and ultrasonically seamed to create overlapping front sections and arm holes, the sleeves being formed by a pair of smaller blanks which are folded and ultrasonically seamed to create a tubular sleeve which is joined to the arm holes on the body of the gown.

Also an object of this invention is to provide a disposable gown of the above type which can be mass-produced at low cost.

Briefly stated, these objects are attained in a disposable, double-breasted gown for medical patients fabricated of non-woven, synthetic plastic sheeting. The gown body is formed from a rectangular blank whose straight upper long edge is die cut to provide chamfered corners, an off-center neck indentation and isosceles triangular arm hole indentations on the left and right sides of the arcuate indentation, the resulting straight edge shoulder segments formed between the corners and the indentations all having the same length. The peaks of the triangular indentations are aligned with parallel left and right transverse fold lines that define a rear gown section on one side of which is a relatively narrow left-front gown section, and on the other side of which is a broad right-front gown section. The left-front section is folded over the rear section and the right-front section is then folded over to overlap the folded left-front section, the straight edge segments of the folded over left and right front sections being ultrasonically bonded to the corresponding segments of the rear section to define left and right arm openings. Ultrasonically seamed to these arm openings are short sleeves to complete the gown which is then provided with a tie string, one being attached to the rear panel and the other to the right-front section.

BRIEF DESCRIPTION OF DRAWINGS

For a better understanding of the invention as well as other objects and further features thereof, reference is made to the following detailed description to be read in conjunction with the accompanying drawings wherein:

FIG. 3 shows the die-cut flat blank from which the body of the gown is formed;

DESCRIPTION OF INVENTION

Figure 2:
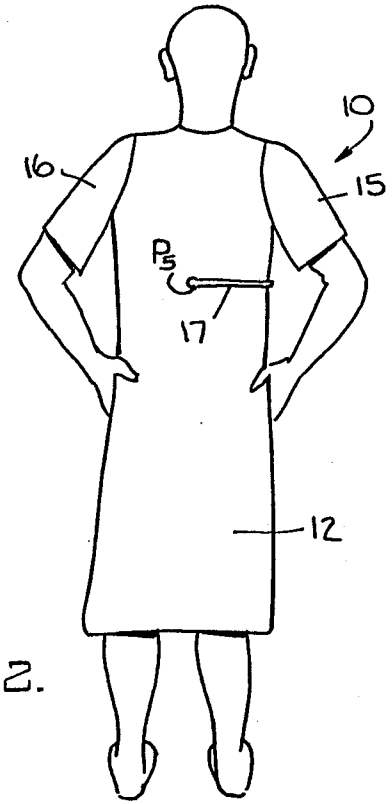
FIG. 2 is a rear perspective view of the patient wearing the gown.
Figure 1:
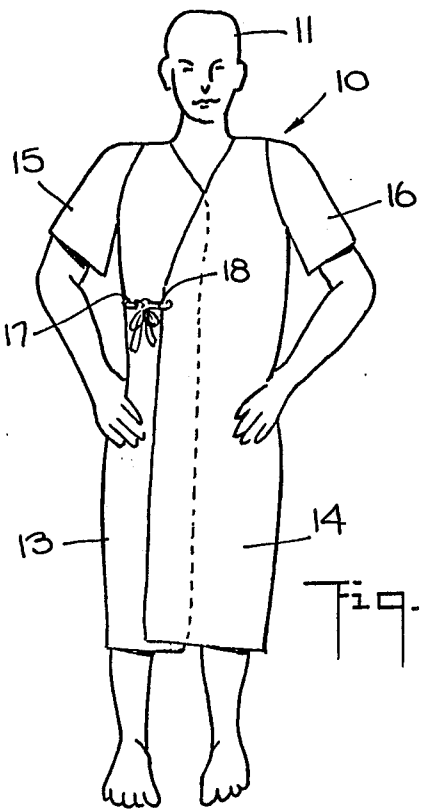
FIG. 1 is a front perspective view of a patient wearing a medical gown according to the invention.

Referring now to FIGS. 1 and 2, there is illustrated, front and back, a medical gown 10 in accordance with the invention, worn by a patient 11. Gown 10 includes a body composed of a rear section 12, a relatively narrow, left-front section 13 and a broader right-front section 14 which overlaps the left-front section 13 so that the gown is double breasted. Ultrasonically seamed to the arm openings of the gown body are short sleeves 15 and 16.

Attached to the outer surface of rear section 12 is a tie string 17, and attached to the margin of right front section 14 is a tie string 18, the two strings being tied together when the gown is worn.

The entire gown is fabricated of non-woven sheeting constituted by randomly-dispersed synthetic plastic fibers forming a fabric which satisfies practical as well as medical requirements. From the practical standpoint, the non-woven material, since it makes direct contact with the body of the patient, must be reasonably soft and comfortable, and also afford some degree of warmth. Thus fabrics formed of woven, monofilament polyester fibers are notoriously "cold," for these woven fibers do not entrap air to provide thermal insulation. However, fabrics created by non-woven polyester fibers have a wool-like or fibrous texture and even though thin, they function as thermal insulation.

But in addition to being soft and comfortable, the non-woven fabric, from the standpoint of satisfying medical and safety requirements, must be sterile, non-allergenic, non-toxic and flame retardant. Suitable for this purpose is the nonwoven sheeting marketed by Burlington Industries under the NEXUS trademark.

The nature of the sheeting must be such that it lends itself to ultrasonic seaming. The fibers used in the non-woven sheeting may be polyester (Dacron), polyolefin, polyvinyl, or any other type capable of being processed into a non-woven fabric which can be ultrasonically seamed. Also usable are blends of cotton and polyester, as well as tubular plastic fibers having entrapped air pockets therein to promote warmth and softness. Since the gown is discarded after a single wearing, the material employed need not be launderable and therefore may be of very low cost construction.

Rear section 12 of the gown is uninterrupted, whereas the double-breasted front is composed of overlapping sections 13 and 14; hence the gown, when worn, shields the body against germs. And because of the double-breasted front section which is held together by ties, the gown is effectively expandable to conform the gown to the girth of the wearer.

The body of the gown is fabricated, as shown in FIG. 3, from a single, large rectangular blank BB of non-woven sheeting. In practice, blank BB may be 36"×65" in size, so that the gown is long enough to fall below the knees of even tall patients. The upper long straight edge of blank BB is die cut to form chamfered corners 19 and 20, an off-center arcuate neck indentation 21 and left and right identical isosceles triangular armhole indentations 22 and 23 on either side of arcuate indentation 21. These cuts are so positioned along the upper straight edge as to result in straight upper edge segments $S_1$, $S_2$, $S_3$ and $S_4$, all of which have the same length and are along a common line.

The peak $P_1$ of triangular indentation 22 is aligned with a transverse left fold line $F_1$, while peak $P_2$ of triangular indentation 23 is aligned with a transverse fold line $F_2$ parallel to fold line $F_1$. Fold lines $F_1$ and $F_2$ respectively define the junction between rear section 12 and the narrow left-front section 13, and the junction between section 12 and the broader right-front section 14.

Figure 4:
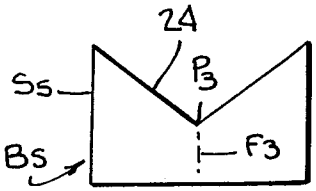
FIG. 4 illustrates a die-cut blank from which a sleeve for the gown is formed.

To form the sleeves, two smaller blanks BS are provided of the same non-woven material as the body blank, one of which is shown in FIG. 4. Blank BS is die cut at its upper edge to form an isosceles triangular indentation 24 which extends to the upper corners of the blank and whose peak $P_3$ is aligned with a center fold line $F_3$. The lower edge $S_5$ of this die-cut blank is straight.

Figure 5:
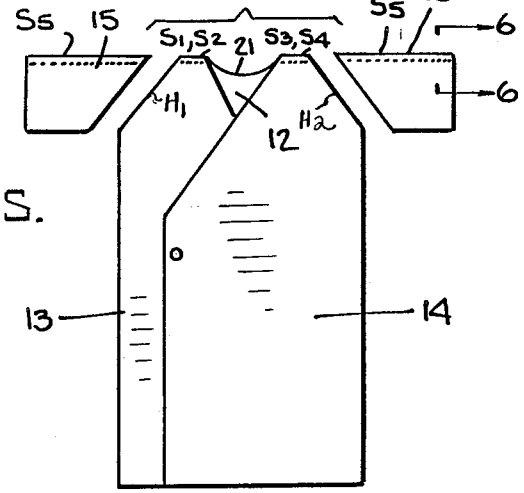
FIG. 5 shows how the body and sleeve blanks are folded and seamed ultrasonically to create the gown.

To create the body of the gown, first the narrow left-front section 13, as shown in FIG. 5, is folded over rear section 12 so that the straight upper edge segments $S_1$ and $S_2$ are then superposed to create an arm hole $H_1$. Then the broad right-front section 14 is folded over the folded left-front section to overlap this section so that the straight upper edge segments $S_3$ and $S_4$ are superposed to create an arm hole $H_2$.

To complete the body of the gown and to join the sleeves to the armholes of the body, the sleeve blanks BS are each folded in half, as shown in FIG. 5, and the resultant sleeve inlets are brought into registration with arm holes $H_1$ and $H_2$ of the body so that the folded straight edge $S_5$ of the sleeves is now in line with superposed straight edges $S_1$–$S_2$ and $S_3$–$S_4$ of the body, thereby making it possible to ultrasonically seam these edges in a single straight line operation, and to along a diagonal ultrasonically seam the sleeve inlets to the arm holes $H_1$ and $H_2$.

Then ties 17 and 18, which are preferably tapes made of the same material as the gown but in contrasting color, are ultrasonically attached at their respective ends to the rear section 12 at point $P_1$ and the margin of right-front section 14 at point $P_2$. In practice, the ties may be made of white polyester tape, and the gown of blue, non-woven fabric sheeting.

Figure 6:
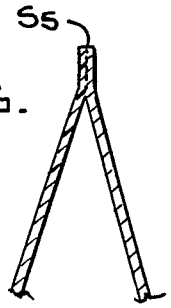
FIG. 6 shows an ultrasonically formed seam.
Figure 7:
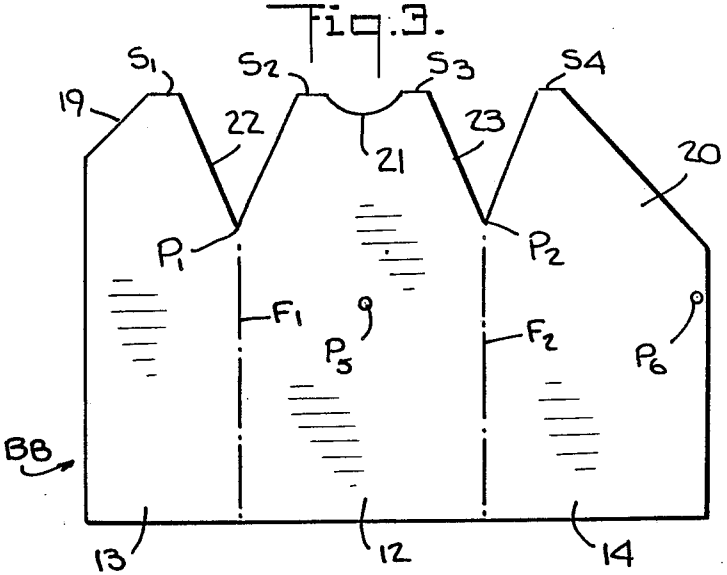

The ultrasonic seams, as indicated in FIGS. 5 and 6 by dashed lines, create ridges which when the gown is worn are on the exterior of the gown. Hence the smooth interior of the gown is free of ridges, so that the skin of the wearer is not irritated by ridges. Because now sewing is entailed, the gown lends itself to high speed, low cost production.

While there has been shown and described a preferred embodiment of a disposable gown for medical patients in accordance with the invention, it will be appreciated that many changes and modifications may be made therein without, however, departing from the essential spirit thereof. Thus while the gown has been shown as it is worn by a patient so that its front can be opened, in practice the gown may be worn in reverse with the opening in the back, so that the front of the gown is now the uninterrupted back panel. Hence the gown can be worn front or back.

I claim:

1. A disposable, double-breasted gown for medical patients formed, without sewing, of non-woven synthetic plastic fabric sheeting which is soft and ultrasonically sealable, said gown comprising:

A a body formed from a rectangular blank having a straight upper long edge that is die cut to form chamfered corners on either side, an off-center arcuate neck indentation and isosceles triangular arm hole indentations on the left and right sides of the arcuate indentation, the resultant straight edge shoulder segments formed between the corners and the indentations all having the same length and a common line, the peaks of the triangular indentations being aligned with parallel left and right transverse fold lines that define between the lines a rear gown section on one side of which is a relatively narrow left-front section and on the other side of which is a broad right-front section, the left-front section being folded over the rear section and the right-front section being folded over the folded left-front section to overlap this section, the straight edge segments of the left and right front sections being ultrasonically seamed to the corresponding segments of the rear section to define left and right arm holes; and B a pair of sleeves whose inlets are ultrasonically seamed to the arm holes of the body, each sleeve being formed of a relatively small rectangular blank having at its upper edge an isosceles triangular indentation whose peak is aligned with a center transverse fold line, and having a straight lower edge, such that when this blank is folded in half, and the folded over lower straight edge is ultrasonically seamed, this creates a tubular sleeve having an inlet which is ultrasonically seamed to the arm holes of the body of the gown.

2. A gown as set forth in claim 1, wherein said ultrasonic seaming produces ridges which are on the exterior of the gown, the interior thereof being smooth and free of ridges.

3. A gown as set forth in claim 1, formed of nonwoven polyester fibers to provide a gown having soft characteristics.

4. A gown as set forth in claim 1, having a length of at least 35 inches.

5. A gown as set forth in claim 1, having two ties attached thereto, one to a point on the rear surface of the rear section and the other to a point on the margin of the right front section.

6. A gown as set forth in claim 5, wherein said ties are formed of tape of the same material as the gown but in a contrasting color.

* * * * *